US007516871B2

(12) United States Patent
Gerbron

(10) Patent No.: US 7,516,871 B2
(45) Date of Patent: Apr. 14, 2009

(54) PACKAGE COMPRISING A PRESSURE-DEFORMABLE CONTAINER AND METHOD FOR MAKING SAME

(76) Inventor: Jacques Gerbron, 19 Avenue Carnot, Menton (FR) 06500

( * ) Notice: Subject to any disclaimer, the term of this patent is extended or adjusted under 35 U.S.C. 154(b) by 498 days.

(21) Appl. No.: 10/506,437

(22) PCT Filed: Mar. 4, 2003

(86) PCT No.: PCT/FR03/00681

§ 371 (c)(1),
(2), (4) Date: Sep. 2, 2004

(87) PCT Pub. No.: WO03/074373

PCT Pub. Date: Sep. 12, 2003

(65) Prior Publication Data

US 2005/0121478 A1 Jun. 9, 2005

(30) Foreign Application Priority Data

Mar. 6, 2002 (FR) ..... 02 02986
Jul. 19, 2002 (FR) ..... 02 09357

(51) Int. Cl.
*B65D 35/00* (2006.01)

(52) U.S. Cl. ..... 222/92; 222/541.1; 215/250

(58) Field of Classification Search ..... 222/92, 222/106, 87–90, 556, 107, 541.1, 541.6, 222/541.7, 541.5; 383/94, 210, 210.1, 211, 383/80; 215/47–54, 232, 250; 220/359.4, 220/359.5, 265, 266
See application file for complete search history.

(56) References Cited

U.S. PATENT DOCUMENTS

| | | | | | |
|---|---|---|---|---|---|
| 3,994,412 | A | * | 11/1976 | Difiglio | 220/266 |
| 4,137,117 | A | * | 1/1979 | Jones | 156/294 |
| 4,303,067 | A | * | 12/1981 | Connolly et al. | 604/408 |
| 4,319,701 | A | | 3/1982 | Cambio | |
| 4,501,372 | A | * | 2/1985 | Hansen | 215/247 |
| 4,636,204 | A | * | 1/1987 | Christopherson et al. | 604/535 |
| 4,962,862 | A | * | 10/1990 | Farrington et al. | 220/613 |
| 5,152,755 | A | * | 10/1992 | Yoshinori | 604/256 |
| 5,348,183 | A | | 9/1994 | Adams et al. | |
| 5,568,876 | A | * | 10/1996 | Schutz | 220/254.8 |
| 5,670,108 | A | * | 9/1997 | Kern et al. | 264/248 |
| 6,241,132 | B1 | | 6/2001 | Morrison | |

FOREIGN PATENT DOCUMENTS

| | | |
|---|---|---|
| DE | 817 097 | 10/1951 |
| FR | 1 241 429 | 9/1960 |
| FR | 2 776 770 | 10/1999 |
| WO | 96/22919 | 8/1996 |

* cited by examiner

*Primary Examiner*—Lien T Ngo
(74) *Attorney, Agent, or Firm*—Young & Thompson

(57) ABSTRACT

A package (1) having a pressure deformable container (2) and a head (3) adapted to be ruptured for the dispensing of the contained product. The dispensing head includes a neck (4) secured to the container (2) and delimiting an orifice, and a nozzle (5) secured to the neck (4), the nozzle (5) and the neck (4) each having a bearing surface oriented radially relative to the orifice and adapted to be placed into contact for securement. A process is also provided for the production of such a package.

24 Claims, 5 Drawing Sheets

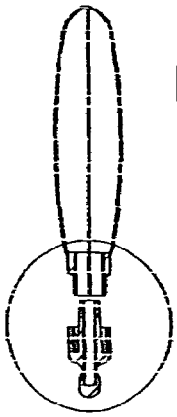
FIG. 4
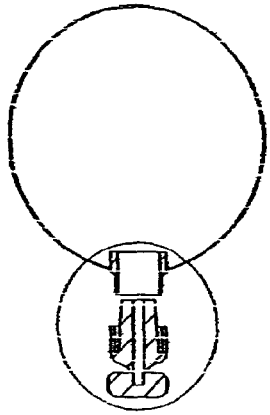
FIG. 5
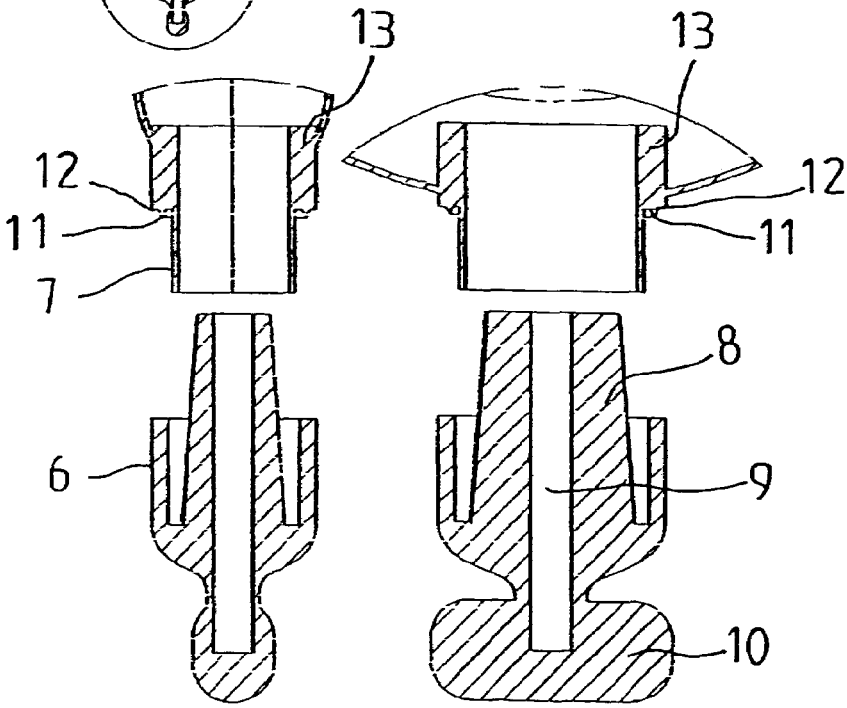
FIG. 6
FIG. 7

PACKAGE COMPRISING A PRESSURE-DEFORMABLE CONTAINER AND METHOD FOR MAKING SAME

The present invention relates to a package comprising a pressure deformable container and a dispensing head adapted to be ruptured for the dispensing of the contained product, as well as a process for its production.

The invention will find application particularly in the field of packaging cosmetic, pharmaceutical or of food products and for the production of various specimens.

There are already known various single dose packages that can be present in the following forms:

- blisters or blisters with two shells, thermoweldable sachets, high frequency welded sachets, etc.

These products give rise to all manner of aesthetic and shape constraints whose more or less wide peripheral welds can be aesthetically unattractive.

- gelatin capsules, but of which the use requires types of product formulation of substantially anhydrous contents.
- tubes or other containers injected in the required shape or of typical or framed geometry which thus cannot be in all cases satisfactory.
- products known as BFS (Blow-Fill-Seal) which give rise to very high cost and time consuming production of tooling, essentially used for large sterile fillings and only for contents of high added value.

Moreover, these products have a very typical aesthetic limited to existing machines and to the production in strips.

Generally speaking, different containers are known with an internal volume closed by a plug adapted to be ruptured and having at the opposite end a filling channel.

The filling channel is generally formed in the same production phase as the container and is closed once filling is completed.

This type of packaging also has applications and shapes that are very limited and require different additional operations for filling (production of a flow channel, filling, closing the flow channel and welding to close the corresponding opening).

The invention permits overcoming the drawbacks of the packages known up to now.

It provides for this purpose a new package which has the advantage of having very few shape constraints.

There can thus be produced packages of very various shapes fulfilling the expectations of marketers and users.

Another advantage of the invention is greatly to reduce the cost of production of such packages.

This factor is particularly important in the face of production of single dose packages in which the cost of production must be as low as possible.

Other objects and advantages will become apparent from the description which follows, relating to a preferred embodiment of the invention.

The present invention relates to a package comprising a pressure deformable container and a head adapted to be ruptured for the dispensing of the contained product, characterized by the fact that the dispensing head comprises a neck secured to the container and delimiting an orifice, and a nozzle secured to the neck, the nozzle and the neck each comprising a bearing surface oriented radially relative to the orifice and adapted to be placed into contact for securement.

According to preferred modifications:

- the nozzle comprises a guide surface coacting with a wall of the neck for mounting the nozzle;

- the bearing surface of the neck is a flange projecting on the internal wall of the neck and the bearing surface of the nozzle is the distal end of a skirt;
- the bearing surface of the neck is its distal end and the bearing surface of the nozzle is a flange of the nozzle;
- the flange is formed on the external wall of a skirt;
- it comprises an internal reservation between the contact zone of the bearing surfaces of the neck and of the nozzle and of the zone of packaging of the product in the container and delimited by the walls of the skirt and of the neck;
- the internal reservation is separated from the packaging zone of the product in the container by an incline of the wall of the neck;
- the nozzle comprises a peripheral portion covering the distal end of the neck;
- the bearing surface of the neck is a flange projecting on the external wall of the neck and the bearing surface of the nozzle with the distal end of a skirt;
- the skirt is adapted to be applied against the external wall of the neck;
- the nozzle and the neck are secured by a weld bead at the bearing surfaces;
- the neck comprises a rigidification zone;
- the nozzle comprises a central portion traversed by a flow channel;
- the nozzle comprises an end zone adapted to be ruptured to free the flow channel;
- said central portion coacts with the internal wall of the neck.

The invention also relates to a process for the production of a package comprising a pressure deformable container and a head adapted to be ruptured for the dispensing of the contained product, for the production of the package, characterized by the fact that it comprises the following steps:

- formation of a container with a neck delimiting an orifice;
- formation of a nozzle with a skirt;
- mounting the nozzle on the neck by placing in contact a bearing surface of the neck and a bearing surface of the nozzle;
- welding the skirt on the neck at the bearing surfaces.

This process can moreover comprise the following steps:

- filling the container through the neck before assembling the nozzle.
- welding the skirt on the nozzle by ultrasonic welding or by friction.
- the container is formed by blow molding.
- the nozzle is mounted on the neck by guiding the nozzle against the neck by a guide surface formed on the nozzle.

The accompanying drawings are given by way of example and are not limiting of the invention. They show two embodiments of the invention and will permit easy comprehension of it.

FIGS. 4 and 5 are cross-sections of the package according to the invention.

FIGS. 6 and 7 are detailed views.

Figure 1:
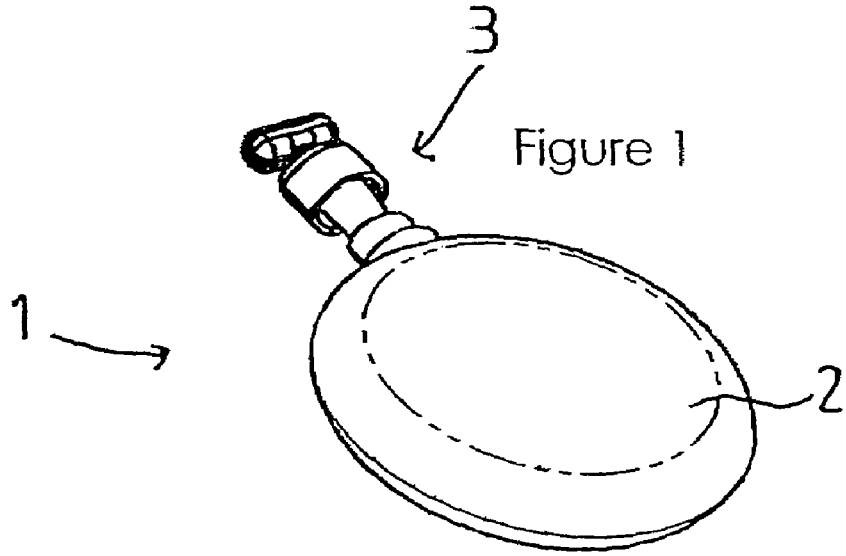
FIG. 1 is a general perspective view of the package according to the invention.
Figure 2:
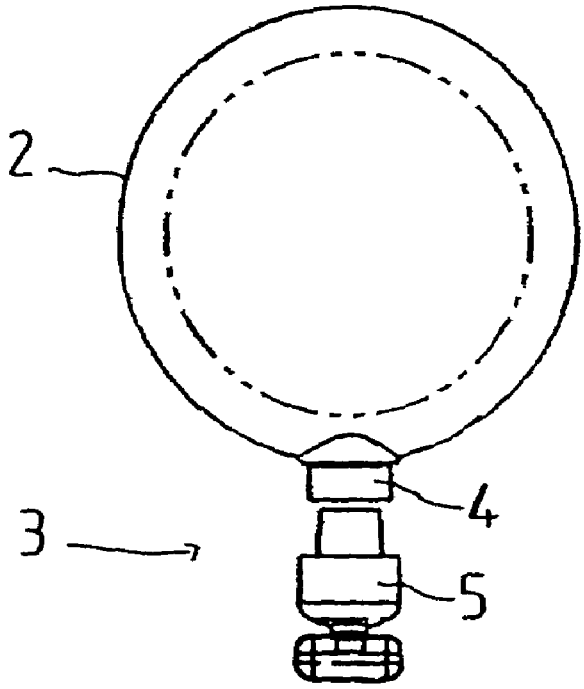
FIGS. 2 and 3 are respectively a top plan view and a side view.
Figure 3:
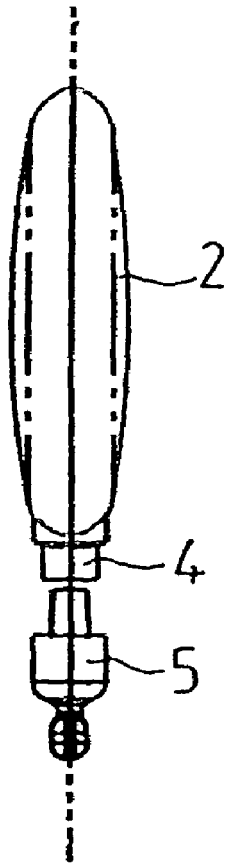

Generally speaking, the package 1 of the invention permits effective assembly of the nozzle 5 and the neck 4 constituting the head. This assembly is carried out by securing two bearing surfaces (one on the neck 4, the other on the nozzle 5) after they come into contact. A welding technique is employed with advantage to this end.

Preferably, the guiding of the nozzle 5 on the neck 4 is ensured during mounting.

This guiding can be effected by co-action of the lateral surfaces of the neck 4 and the nozzle 5 (in particular by the surface of an internal or external skirt 6 on the nozzle 5 and an internal or external wall on the neck 4).

It will be noted that the adjustment between these surfaces can be slightly gripped (to take part in securement) or on the contrary is sliding so as to produce only a simple axial guidance.

There will be described hereafter a first embodiment of the invention.

With reference to FIG. 1, the package shown here comprises a pressure deformable container 2, here in the form of a flexible pocket particularly producible by blow molding.

The package 1 moreover comprises a dispensing head 3 closing the pressure deformable container 2 and adapted to be opened for dispensing the product.

As shown in the various figures, no other opening is necessary for carrying out the filling of the container.

The dispensing head 3 is for this purpose made in two parts assembleable once the filling has been completed.

The first part of the dispensing head 3 is constituted by a neck 4 secured to the container and delimiting an opening.

Preferably, the neck 4 is made during the step of production of the container 2 and formed from its material.

The neck 4 defines a projection having an external wall 7 particularly shown in FIG. 6.

Moreover, the neck can comprise a rigidifying zone 13 adapted to render more massive the body of the neck 4 and to avoid its untimely deformation during handling.

The dispensing head 3 moreover comprises a nozzle 5 comprising a skirt 6 adapted to co-act (with ungripped adjustment) with the external wall 7 of the neck 4.

The nozzle 5 is thus ensleeved on the neck 4 until it preferably reaches a flange 12 comprising or not a weld bead 11 for the final securement of the skirt 6 on the neck 4.

The welding can be effected by an ultrasonic technique or else by friction.

Any other known form of welding can also be used.

The nozzle 5 also comprises preferably a central portion 8 also visible in the figures and particularly in FIGS. 6 and 7.

The central portion 8 has the purpose of being inserted in the opening formed by the neck 4 and preferably to be applied against the internal wall of this neck.

To facilitate ensleevement, the central portion 8 can have a truncated conical shape.

To permit evacuation of the contained product, the central portion 8 comprises moreover a flow channel 9 opening at one end into the internal volume of the container 2 and closed at its other end.

This closure can be effected by an end zone 10 adapted to be ruptured, of conventional design.

The nozzle 5 will be adapted to the destination of the package.

Particularly, it is possible to calibrate or to arrange the flow channel 9 so as to obtain specific quantity delivery (such as calibrated drops) or of the outlet type of the product (such as a spray).

It is also possible to add or to form in the nozzle an applicator for the product.

The process set forth is adapted to the production of the container 1 described above.

Preferably, the process comprises a step of filling the container 2 after the formation of the container with the neck but before the assembly of the nozzle 5 on the neck 4.

In this way, there is used the same opening for filling as for securement of the dispensing head 3.

The filling and assembly can be effectuated in line by a semiautomatic or automatic machine providing the containers 2, the ink jet marking of the necessary legal notices, filling, providing the nozzles, welding them, particularly by an ultrasonic technique, on the containers 2.

Figure 9:
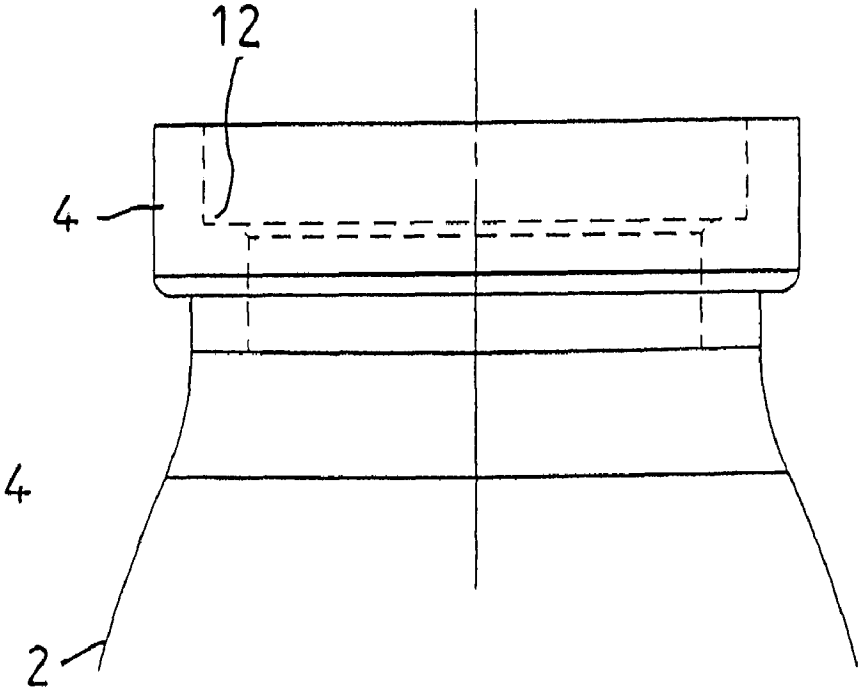
FIGS. 8 to 10 show a second embodiment of the invention.
Figure 8:
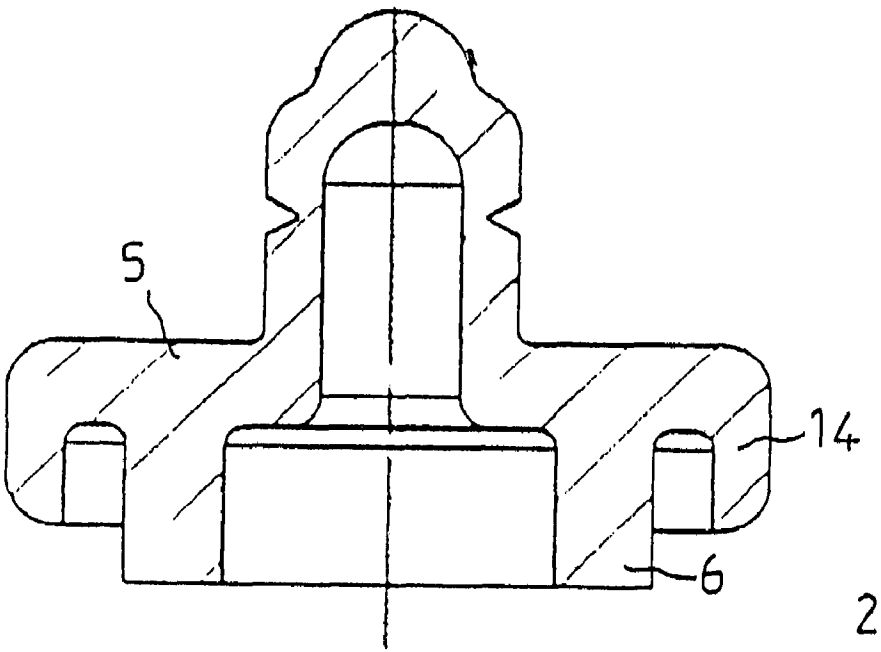
Figure 10:
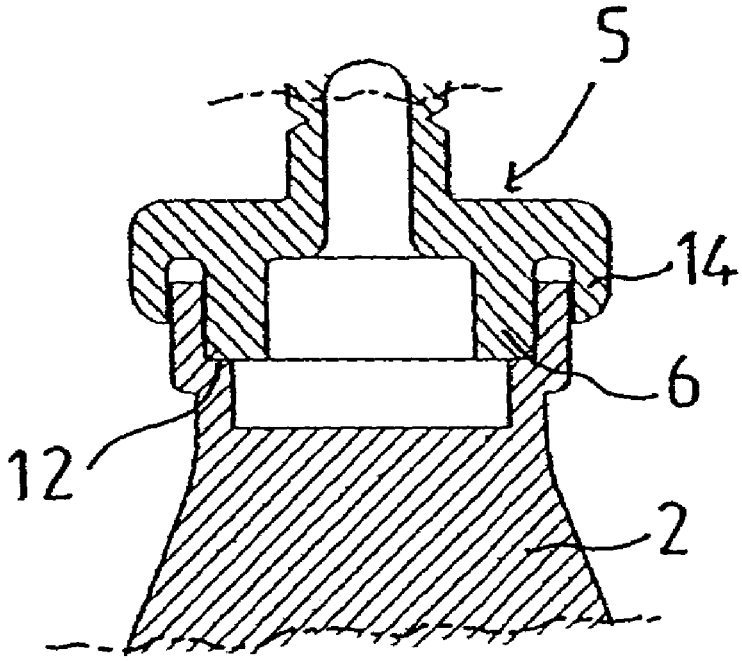

Referring now to FIGS. 8 to 10, there will be described another embodiment of the package 1.

According to this possibility, the flange 12 is internal to the neck 4 and constitutes a bearing surface for the distal end of a skirt 6 adapted to be inserted in the opening of the neck 4.

Preferably, the nozzle 5 comprises moreover a peripheral portion 14 surrounding the junction zone between the neck 4 and the nozzle 5 and covering the distal end of the neck 4.

In this way, the assembled parts are perfectly masked from the outside.

Except for these differences, the package 1 according to this modification could be formed in a way similar to the previously described embodiment.

It will be noted that the bearing surface of the nozzle 5 can also be formed by a flange projecting on the internal wall or external wall and on which the distal end of the neck 4 is applied.

In this light, there will now be described a third embodiment of the invention shown in FIG. 11.

In this figure, the welding flange 12 of the neck 4 is constituted by the thickness of the distal end of the neck 4. This end is applied for welding against the flange 17 here formed on the exterior of the skirt 6. In the illustrated case, a peripheral portion 14 is present (as in the second embodiment), which means that the flange 17 is interposed between the skirt 6 and the peripheral portion 14.

Preferably, the co-action of the walls of the neck 4 and of the skirt 6 is provided to preserve an internal reservation 15 isolating the welding zone from the volume for receiving the product of the container 2.

Figure 11:
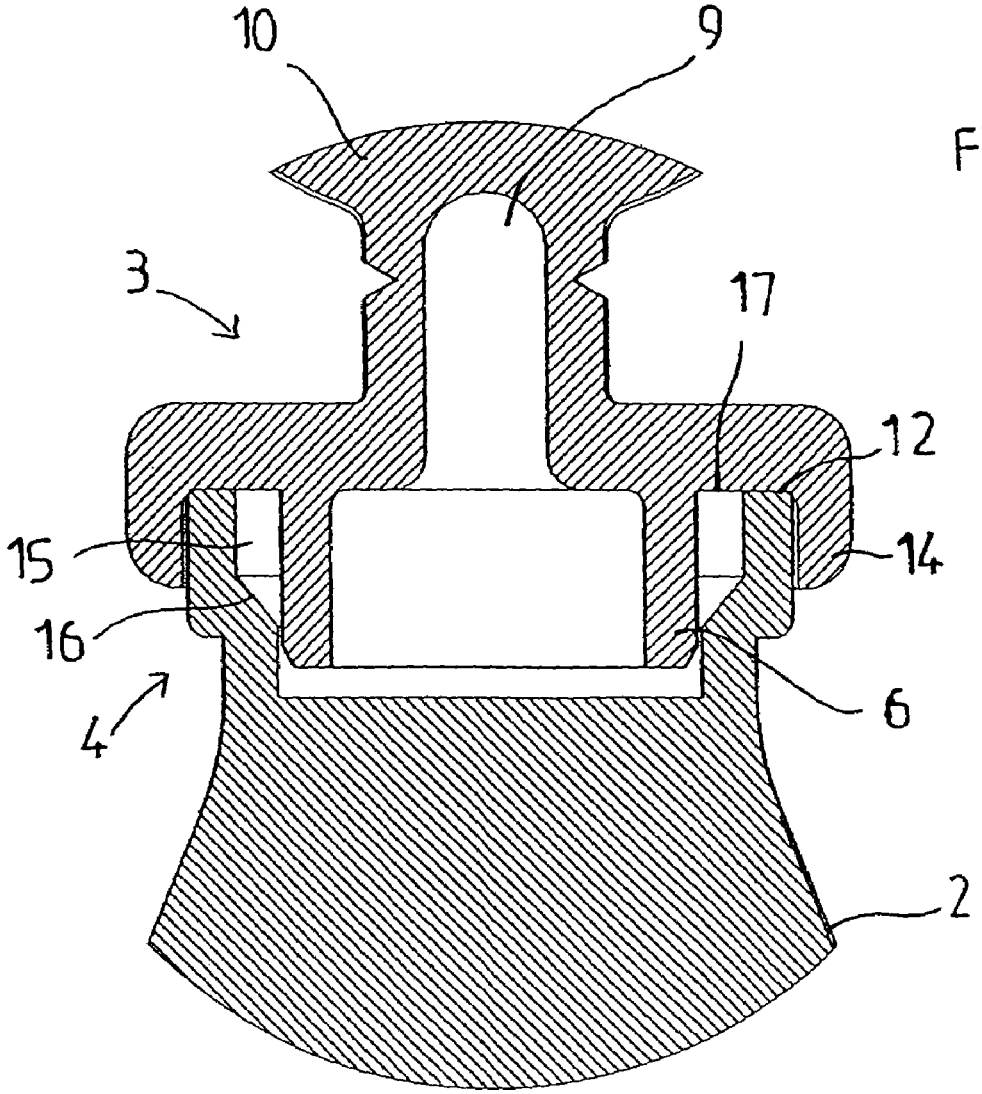
FIG. 11 shows a third embodiment of the invention.

By way of example, there is shown in FIG. 11 an internal reservation 15 formed between the internal wall of the neck 4 and the external wall of the skirt 6 and delimiting at the lower portion by an incline 16 on the neck 4 made by increasing the thickness of the neck 4 at this point, which moreover improve the rigidity of the neck 4 in the form of a rigidification zone 13.

There can be formed an incline on the external wall of the skirt 6 without departing from the scope of the invention.

The internal reservation 15 avoids any contamination of the product contained by projections of material produced during the welding operation. Residues of plastic material can thus be produced by the welding, particularly by friction.

A gripped adjustment of the neck 4 and of the bottom of the skirt 6 is not really necessary in order for the reservation 15 to have effect. A slight play can exist.

Such a package and its process of production have the advantage of having high economical value, which multiplies the possible applications particularly for packages sold in multiple quantities such as advertising specimens or various single dose packages.

REFERENCES

1. Package
2. Container
3. Head

4. Neck
5. Nozzle
6. Skirt
7. External wall
8. Central portion
9. Flow channel
10. End zone adapted to be ruptured
11. Weld bead
12. Flange
13. Ridigity zone
14. Peripheral portion
15. Internal reservation
16. Incline
17. Flange

What is claimed is:

1. A package (1), comprising:

a pressure deformable container (2) for containing a product; and a dispensing head (3) adapted to be ruptured for dispensing of the contained product, wherein, the dispensing head (3) comprises i) a neck (4) formed on the container (2) and delimiting an orifice, and ii) a nozzle (5) comprising a skirt (6), the nozzle (5) and the neck (4) each comprise a bearing surface, the nozzle (5) is mounted on the neck (4) with the bearing surface of the neck (4) contacting the bearing surface of the nozzle (5), and a weld (11) welding the skirt (6) to the neck (4) at said bearing surfaces, wherein the bearing surface of the neck (4) is its distal end and the bearing surface of the nozzle (5) is a flange (17) on the nozzle (5), the flange (17) is formed on an external wall of the skirt (6), and an internal reservation (15) between the contact zone of the bearing surfaces of the neck (4) and the nozzle (5) and a packaging region for the product in the container (2) and delimited by the walls of the skirt (6) and of the neck (4).

2. The package (1) according to claim 1, wherein the nozzle (5) comprises a guide surface coacting with a wall of the neck (4) for mounting the nozzle (5).

3. The package (1) according to claim 1, wherein the internal reservation (15) is separated from the packaging zone for the product in the container by an incline (16) on the wall of the neck (4).

4. The package (1) according to claim 1, wherein the nozzle (5) comprises a peripheral portion (14) covering the distal end of the neck (4).

5. The package (1) according to claim 1, wherein the neck (4) comprises a rigidification zone (13).

6. The package (1) according to claim 1, wherein the nozzle (5) comprises a central portion (8) traversed by a flow channel (9).

7. The package (1) according to claim 6, wherein the nozzle (5) comprises an end zone (10) adapted to be ruptured to free the flow channel (9).

8. The package (1) according to claim 6, wherein said central portion (8) coacts with the internal wall of the neck (4).

9. Process for the production of a package (1), comprising the steps of:

forming a container (2) with a neck (4) delimiting an orifice;

forming a nozzle (5) with a skirt (6);

mounting the nozzle (5) on the neck (4) and bringing into contact a bearing surface of the neck (4) with a bearing surface of the nozzle (5);

welding the skirt (6) on the neck (4) at said bearing surfaces, wherein the neck and nozzle form a dispensing head (3) adapted to be ruptured for dispensing product contained in the container, forming the bearing surface of the neck (4) by its distal end and the bearing surface of the nozzle (5) by a flange (17) on the nozzle (5);

forming the flange (17) on the external wall of the skirt (6); and forming an internal reservation (15) between the contact zone of the bearing surfaces of the neck (4) and the nozzle (5) and a packaging region for the product in the container (2) and delimited by the walls of the skirt (6) and of the neck (4).

10. The process according to claim 9, wherein the container (2) is filled through the neck (4) before assembling the nozzle (5).

11. The process according to claim 10, wherein the skirt (6) is welded on the neck (4) by ultrasonic welding or by friction.

12. The process according to claim 9, wherein the container (2) is formed by blow molding.

13. The process according to claim 9, wherein the nozzle (5) is mounted on the neck (4) by guiding the nozzle (5) on the neck (4) by a guide surface formed on the nozzle (5).

14. The process according to claim 9, wherein the bearing surfaces are formed with a radial orientation relative to the orifice.

15. The process according to claim 9, comprising separating the internal reservation (15) from the packaging zone for the product in the container by forming an incline (16) on the wall of the neck (4).

16. The process according to claim 9, comprising covering the distal end of the neck (4) with a peripheral portion (14) of the nozzle (5).

17. The process according to claim 9, comprising securing the nozzle (5) and the neck (4) by a weld bead (11) at the bearing surfaces.

18. The process according to claim 9, comprising forming a rigidification zone (13) on the neck (4).

19. The process according to claim 9,comprising forming a central portion(8) traversed by a flow channel (9) on the nozzle.

20. The process according to claim 19, wherein an end zone (10) of the nozzle (5) is adapted to be ruptured to free the flow channel (9).

21. The process according to claim 20, including making coact central portion (8) with the internal wall of the neck (4).

22. Package (1) according to claim 1, wherein the bearing surfaces are oriented radially relative to the orifice, and said container is a blowmolded container.

23. The package of claim 1, wherein, the pressure deformable container (2) contains a single dose of a cosmetic, a pharmaceutical, or a food product.

24. The package of claim 9, wherein, the packaging region contains a single dose of a cosmetic, a pharmaceutical, or a food product.

* * * * *